US005146696A

United States Patent [19]

Mayer et al.

[11] Patent Number: 5,146,696

[45] Date of Patent: Sep. 15, 1992

[54] DRYING CYLINDER AXIS ARRANGEMENT FOR DRYING SECTION

[75] Inventors: Wolfgang Mayer; Hans-Jurgen Wulz, both of Heidenheim, Fed. Rep. of Germany

[73] Assignee: J. M. Voith GmbH, Fed. Rep. of Germany

[21] Appl. No.: 664,545

[22] Filed: Mar. 4, 1991

[30] Foreign Application Priority Data

Nov. 24, 1990 [DE] Fed. Rep. of Germany ..... 4037423

[51] Int. Cl.[5] ..... F26B 3/24

[52] U.S. Cl. ..... 34/117; 34/113; 34/116

[58] Field of Search ..... 34/114, 115, 116, 117, 34/118, 119, 111, 113, 120, 121, 123

[56] References Cited

U.S. PATENT DOCUMENTS

| | | | |
|---|---|---|---|
| 3,434,224 | 3/1969 | Blomgren et al. | 34/114 |
| 4,625,430 | 12/1986 | Aula et al. | 34/116 |
| 4,934,067 | 6/1990 | Wedel | 34/117 |
| 4,945,655 | 8/1990 | Wedel | 34/117 |
| 4,982,513 | 1/1991 | Loser et al. | 34/116 |
| 5,062,216 | 11/1991 | Hannigan | 34/117 |

*Primary Examiner*—Henry A. Bennet
*Assistant Examiner*—Denise L. F. Gromada
*Attorney, Agent, or Firm*—Ostrolenk, Faber, Gerb & Soffen

[57] ABSTRACT

The drying section of a paper-making machine has a first drying group of a horizontal row of first drying cylinders which alternate with reversing rollers. A first upper web support belt wraps over the top of a first drying cylinder and then wraps the associated first reversing roller. An adjacent second drying group of a horizontal row of second drying cylinders which alternate with reversing rollers. A second lower web support belt wraps over the bottom side of a second drying cylinder and then wraps the associated second reversing roller. The drying cylinders and their reversing rollers are supported on two longitudinal beams which extend beneath the rows of drying cylinders. The drying cylinders of the second group lie at least at the same height above or higher above the longitudinal beams of the drying cylinders than the drying cylinders of the first group. The seocnd drying group is of a height to provide a clearance space over the floor and beneath lower support belt return path guiding rollers. A hood and an intermediate floor between the beams encloses the drying section to contain vapors.

27 Claims, 2 Drawing Sheets 7
8
9
10
11
12
13
14
15
16
17
18
19
19a
20
21
22
23
24
24a
25
26
27
28
28a
29
29a
29b
30
31
32
39
41
42
43
45
54
55
h
III
III 9
10
11
12
13
14
15'
16'
17'
18'
20'
29'
30
31
32
45
56
57
58
59
h
h'

DRYING CYLINDER AXIS ARRANGEMENT FOR DRYING SECTION

BACKGROUND OF THE INVENTION

The present invention relates to a drying section of a machine for manufacturing a fiber web, in particular a web of paper. The drying section has features like those in U.S. Pat. No. 4,934,067. The invention particularly concerns a so called single row or single tier drying section in which the web to be dried is conducted by a first support belt continuously from first drying cylinder to first drying cylinder in a first drying group and is then transferred from the first support belt to a second support belt in a second drying group of second drying cylinders. The transfer avoids an open length of web, i.e. an open draw. The present invention particularly concerns the placement of the axes of the drying cylinders and of the cooperating reversing rollers of a series of the drying groups.

In drying sections of that type, there is a distinction between drying groups which have an upper support belt and drying groups which have a lower support belt. In the first-mentioned drying groups, the web to be dried and the support belt for the web wrap around the upper part of the circumference of the drying cylinders. In this case, the support belt travels from the last cylinder of the drying group, over guide rollers which lie above the drying cylinders, back to the first drying cylinder of this group. In the second-mentioned drying groups having a lower support belt, the wrapping and movements of the web and the support belt are inverted opposite those of the first-mentioned drying groups. The drying groups are arranged along a single row or tier with all drying cylinders parallel.

In the known drying section, the shafts or axes of the drying cylinders of those drying groups which have a lower support belt lie at a smaller vertical distance above the longitudinal support beam of the drying section than the shafts or axes of the drying cylinders of the other drying groups which have an upper support belt.

This known arrangement has the following effect on the design of the places of web transfer between two successive drying groups: The web pick-up roller of the following drying group can be arranged at a relatively small distance from the last support belt reversing roller of the preceding drying group. Nevertheless, it is possible to make the circumferential wrapping regions of the two adjacent drying cylinders which lie at the place of web transfer relatively large so as to obtain the greatest possible transfer of heat to the web.

Although the above noted advantages are obtained, however, there are disadvantages in other respects. On the one hand, the guide rollers of the lower support belts are located in a cellar that is below the longitudinal beams. This makes maintenance of these rollers, for instance, of their bearings, difficult. On the other hand, a large amount of space is lost in the cellar by the support belt guide rollers which are arranged in the cellar and by the support belts which travel over them. That space is thus not available for other units of the web manufacturing machine.

U.S. Pat. No. 3,434,224 discloses that the drying section is customarily covered by a hood which serves primarily for containing and leading away vapors. In principle, such a containment hood is comprised of two lateral longitudinal walls, which stand on the floor of the paper machine, an upper covering wall, and two lower longitudinal walls which are in the cellar. The lower walls are necessary because the guide rollers of the lower support belts are arranged in the cellar. This arrangement has the disadvantage that the volume surrounded by the hood is relatively large. Thus, a relatively large expenditure of energy is necessary to hold the entire inside volume beneath the hood at a desired high temperature.

SUMMARY OF THE INVENTION

The object of the present invention is to improve the drying section of a fiber web manufacturing machine such that the space available below the drying section can be better utilized and to facilitate the operation of the drying section, while the drying performance and the runability do not suffer and rather are further increased.

This object is achieved by the invention. The drying section of a web manufacturing, and particularly a paper making machine, has a first drying group comprised of a preferably horizontal row of a plurality of first drying cylinders which alternate with first reversing rollers along the row. A first, upper web support belt passes over the top circumferential region of each first drying cylinder and then alternately wraps the adjacent first reversing roller. There is an adjacent second drying group comprised of a preferably horizontal row of a second plurality of second drying cylinders which alternate with second reversing rollers. A second, lower support belt partially wraps the circumferential bottom side of each second drying cylinder and then alternately wraps over the adjacent second reversing roller. The delivery of the web from the first support belt to the second support belt enables both sides of the web to directly contact with either one or the other of the groups of drying cylinders. Any sequence of first and second drying groups may be used, with a first group following a second, for example.

The drying cylinders of the first and second drying groups and their respective reversing rollers are supported on longitudinal supporting beam means, typically comprising two longitudinal beams which extend horizontally in the lengthwise direction of the machine beneath the rows of drying cylinders. The drying cylinders of that drying group which has a lower support belt, e.g. the second drying group, are arranged at least at the same height above the longitudinal beams as the drying cylinders of the adjacent, e.g. the first, drying group or groups which has an upper support belt. This means that the second drying cylinders may be higher of the beams than the first drying cylinders. Preferably, all drying cylinders are now arranged at the same height.

The above described drying cylinder height arrangement not only permits providing standard frames for all of the drying cylinders of a drying section, but provides the advantage, in combination with the arrangement of the support belt guide rollers that are above, or at least in the vicinity of, the top of the longitudinal beams, that practically all parts of the drying section can be operated and serviced from the same plane, namely from the so called paper machine floor beneath all other drying section elements. Furthermore, there is space below the drying section for auxiliary units, for instance a central lubricating system or a blower and heat exchanger for the ventilating and venting of the drying section.

Another essential advantage is possible. The two longitudinal beams of the drying section may directly support some of the guide rollers while the frames for the cylinders and for the other rollers rest on those beams. The beams may be connected to each other by an intermediate floor. This provides increased stiffness of the longitudinal beams, which reduces the danger of vibrations. On the other hand, longitudinal walls of the vapor containment hood, which were previously necessary in the cellar, become superfluous. The inside volume of the drying section, which is defined by the longitudinal beam or girders and the intermediate floor and surrounded as a whole by the hood, is considerably smaller than previously so that the energy expenditure for maintaining a given temperature within that inner space is smaller.

BRIEF DESCRIPTION OF THE DRAWINGS

Other objects and features of the invention are described below with reference to the drawings, in which.

DESCRIPTION OF THE PREFERRED EMBODIMENTS

Figure 1:
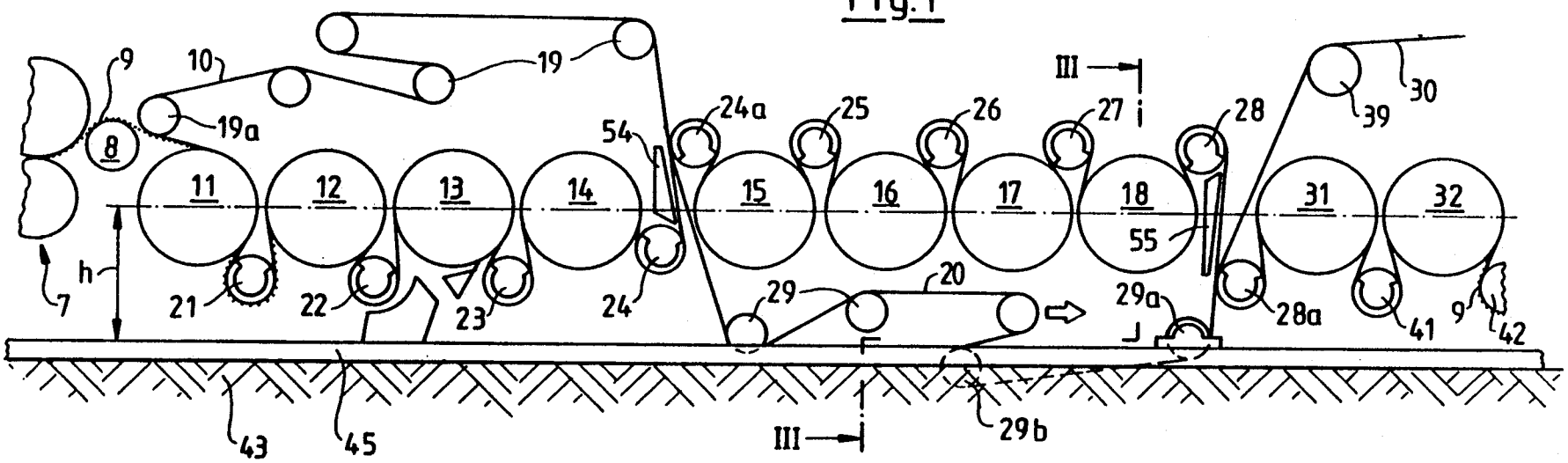
FIG. 1 is a diagrammatic partial side view of a drying section.

The drying section shown is part of a paper making machine. The paper web 9 which is to be dried is shown in part as a dotted line. The web travels from left to right in the drawing through the drying section.

A first drying group comprises four parallel heatable first drying cylinders 11 to 14 in a horizontal row and four first reversing rollers 21 to 24 which lie below the first drying cylinders and also are in a horizontal row and alternate with the drying cylinders. The reversing rollers are preferably developed as suction guide rollers.

A paper web guide roller 8 transfers the web of paper 9 from a preceding press section 7 of the machine to a first endless support belt 10, which is preferably developed as a dryer screen. The first support belt first travels over a guide roller 19*a* which, if necessary, can be developed as a suction roller. The paper web travels together with the first support belt 10, along a meander path, through the first drying group, i.e. alternately over one first drying cylinder 11 to 14 and then over the adjacent first reversing suction roller 21 to 24. From the last suction roller 24, the support belt 10 travels over several ordinary belt guide rollers 19, which lie above the first drying cylinders, and back to the first belt guide roller 19*a*.

The first endless support belt 10 is an upper support belt, i.e. the paper web 9 and the support belt 10 travel substantially over the upper region of the circumference of each first drying cylinder 11 to 14 so that the bottom side of the paper web 9 comes into contact with the top sides of the first drying cylinders.

A second drying group comprises four parallel, heatable, second drying cylinders 15 to 18 in a horizontal row and five second reversing rollers 24*a* and 25 to 28 lying in a horizontal row above the second cylinders 15 to 18. The second reversing rollers alternate with the second drying cylinders. A second support belt 20 travels through the second drying group. From the last second reversing roller 28, the second belt 20 travels over a plurality of normal belt guide rollers 29, 29*a* arranged below the second drying cylinders and back to the first of the second reversing rollers 24*a*. The first one of the second reversing rollers 24*a* is developed as a pick-up roller which transfers the paper web 9 directly from the first support belt 10 to the second support belt 20 without producing an open length of paper web, i.e. an open draw.

The second support belt 20 is a lower support belt, i.e. it wraps predominantly around the lower region of the circumference of the second drying cylinders 15 to 18. Thus, in the second drying group, the top side of the paper web 9 comes into contact with the second drying cylinders.

In the same manner, at the end of the second drying group and therefore following the last second reversing roller 28, as seen in the direction of web travel, the paper web 9 is transferred by another take-up roller 28*a* to the next drying group. At this transfer location also, an open length or draw of paper web is avoided. Only two first drying cylinders 31 and 32 of the third drying group are visible, along with a first upper support belt 30, first reversing rollers 41 and 42, and a belt guide roller 39. The third drying group could be followed by a fourth drying group and possibly by a fifth drying group which correspond in arrangement to the second and third drying groups. The number of drying cylinders per group can, of course, be other than four.

Figure 3:
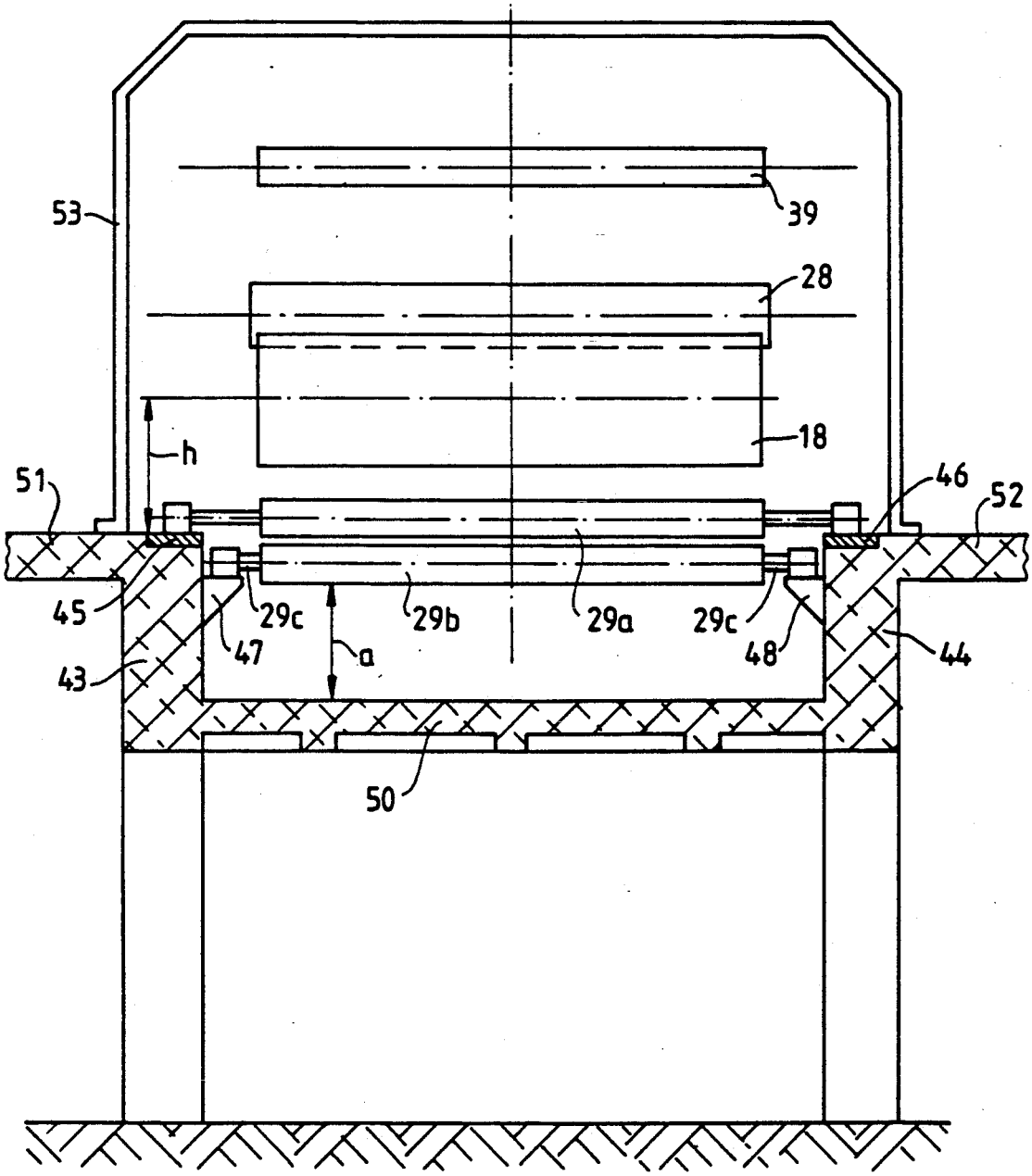
FIG. 3 is a cross section along the line III—III of FIG. 1.

In FIG. 1, all first and second drying cylinders 11 to 18 and 31, 32 lie at the same height h above the upper edge of the two longitudinal beams 43 and 44 (see also FIG. 3). These beams can be developed as steel girders or, as shown, as concrete beams with so called foundation rails 45, 46 seated on them. The frames that stand on the foundation rails, and on which the bearings of the drying cylinders, of the reversing rollers and of some of the guide rollers rest, have been omitted from the drawing. The bearings of the belt guide rollers 29, 29*a* which lie below the second drying cylinders 15 to 18 can be arranged in part directly on the foundation rails 45, 46 (as shown for example by the roller 29*a*). In order that the vertical distance h between the cylinder axes of rotation and the foundation rails 45, 46 might be kept as small as possible, in order to keep the frames free of vibration, that belt guide roller 29*b* which must be located furthest toward the bottom does not rest on the foundation rails 45, 46. Instead, as shown in FIG. 3, the roller 29*b* rests on brackets 47, 48 which are fastened to the inner side surfaces of the longitudinal beams 43, 44. For this reason, the belt guide roller 29*b* has shorter roller pins 29*c* than the other belt guide rollers 29, 29*a*, as can be noted from FIG. 3.

As shown in FIG. 3, the two longitudinal beams 43, 44 are connected by an intermediate floor 50. A vapor containment hood 53 stands on the paper making machine floor 51, 52. The hood, together with the two longitudinal beams 43, 44 and the intermediate floor 50, surrounds all parts of the drying section.

Between the intermediate floor 50 and the bottommost belt guide roller 29*b* there remains a minimum vertical distance a amounting to at least 1 to 2 m. and preferably about 2 m. Thus personnel can walk without danger on the intermediate floor 50 in order, for instance, to remove any waste paper which may be present. For the removal purpose, at least one conveyor belt (not shown in the drawing) can be provided on the intermediate floor 50.

On each of the transfer points between two successive drying groups, for instance between the reversing rollers 24 and 24*a* and 28 and 28*a* respectively, there is provided a relatively long straight travel path from the last reversing roller, for instance 24, to the take-up roller, for instance 24*a*. This makes it is possible to keep the distance between the adjacent drying cylinders, for instance 14 and 15, relatively small, reducing structural length, and enables providing a relatively large web wrapping on these drying cylinders so as to be able to transmit as much heat as possible from the drying cylinders to the paper web.

In order that the paper web 9 nonetheless remain connected as firmly as possible to the support belt, for instance the first belt 10, in the region of this straight travel path (so as to prevent transverse shrinkage), a vacuum generator 54, which draws the paper web against the support belt, is arranged along the straight travel path on the inner side of the support belt. A similar vacuum generator 55 is also provided following the last reversing roller 28 of the second drying group. These vacuum generators are preferably developed with stabilizer walls which act without contacting the belts and which diverge, with respect to the direction of travel of the belt, from the surface of the passing support belt 10 and 20, respectively. Differing from FIG. 1 (and from FIG. 2) however, there may be a smaller vertical distance between the reversing rollers 24, 24*a* and 28, 28*a*, respectively which permits not using the vacuum generators 54, 55.

Figure 2:
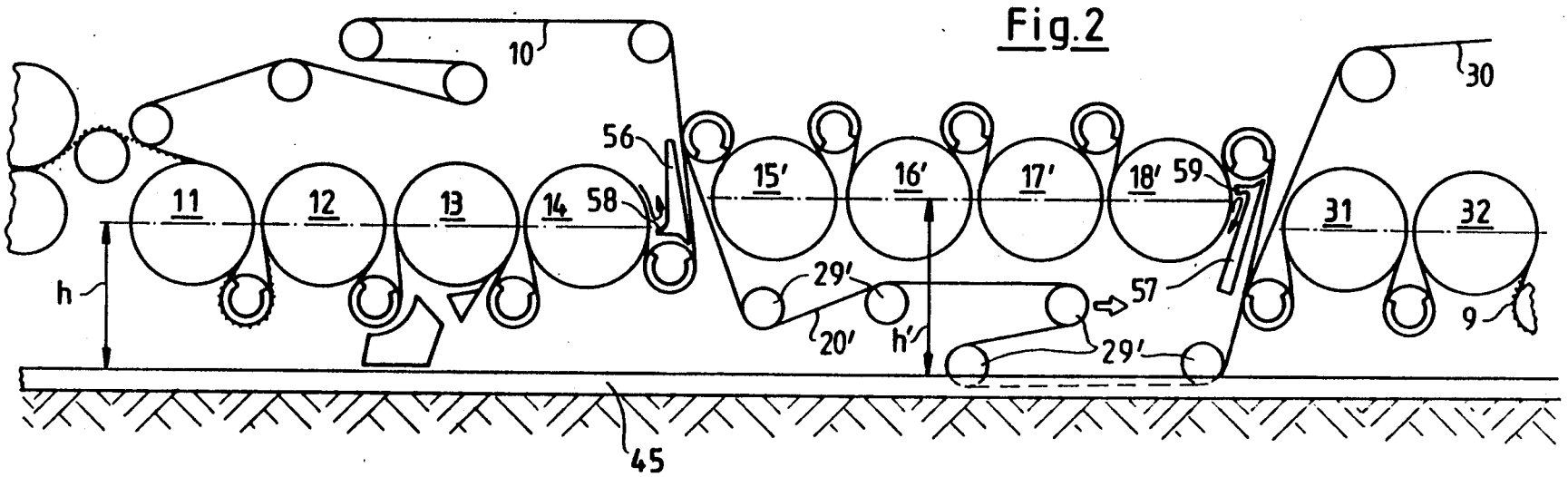
FIG. 2 shows an embodiment which is modified as compared with FIG. 1.

In the embodiment shown in FIG. 2, similar vacuum generators 56, 57 as in FIG. 1 are provided. However, they are provided on their rear, in addition, with reversing devices 58 and 59, respectively, for the air boundary layers that are produced by the support belts 10 and 20, respectively, upon their travel over the respective last drying cylinder.

FIG. 2 furthermore shows that the second drying cylinders 15' to 18' of the second drying group, which has a second lower support belt 20', can be arranged at a somewhat higher vertical distance h' above the foundation rails 45, 46 than the first drying cylinders 11 to 14 and 31, 32 having a first upper support belt 10, 30. In this way, although frames of different height are necessary, nevertheless all of the guide rollers 29' for the lowermost support belt 20' can be of identical development since their bearings can all be arranged above the foundation rails 45, 46. The sequence of first and second drying groups may be reversed, as a second group may precede a first in web travel (as with the second and third groups in FIG. 1).

In all embodiments, the reversing rollers 21 to 24, 24*a*, 25 to 28 and 28*a* can be developed as suction guide rollers with a stationary inner or outer suction box, or else they can be developed as box-less suction guide rollers. It is also possible to develop at least some of the reversing rollers simply merely as guide rollers provided with circumferential grooves.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A drying section for a machine for fabricating a fiber web, the drying section comprising:

a first plurality of heatable drying cylinders arranged in a first row and forming a first drying group; the first drying cylinders having respective first cylinder axes of rotation; a respective first reversing roller associated with each first drying cylinder;

a second plurality of heatable drying cylinders arranged in a second row and defining a second drying group which is adjacent the first drying group; the second drying cylinders having respective second cylinder axes of rotation; a respective second reversing roller associated with each second drying cylinder;

a first upper endless web support belt passing over the top side of one of the first drying cylinders and then over the associated first reversing roller and then over another first drying cylinder, and means for feeding the web beneath the first support belt such that the bottom of the web is wrapped around the top sides of the first drying cylinders with the first support belt above the web;

a second lower endless support belt passing under the bottom side of one of the second drying cylinders and then over the associated second reversing roller and then over another second drying cylinder, and means for feeding the web above the second support belt such that the top side of the web is wrapped around the bottom sides of the second drying cylinders with the second support belt below the web;

the drying cylinders alternating with the respective reversing rollers such that the first support belt directly contacts the first reversing rollers and the second support belt directly contacts the second reversing rollers;

means for transmitting the web from the respective supporting belt at the end of the drying group that is preceding along the path of web travel to the respective supporting belt at the start of the next drying group that follows along the path of web travel;

longitudinal beam means extending in the lengthwise direction of the machine past the first and second drying groups, and the drying cylinders being supported on the beam means;

the second drying cylinder axes are at least at the same height above the longitudinal beams as the first drying cylinder axes.

2. The drying section of claim 1, wherein the second cylinder axes are at a greater height above the longitudinal beams than the first cylinder axes.

3. The drying section of claim 1, wherein the first row of drying cylinders is a horizontal row, the second row of drying cylinders is a horizontal row, the longitudinal beam means extend horizontally in the lengthwise direction of the machine past the first and second horizontal rows of drying cylinders.

4. The drying section of claim 1, wherein the first and second drying groups are arranged in a sequence with one drying group following the other in the path of web travel, such that the first drying cylinder of the following drying group follows the last drying cylinder of the preceding drying group in the path of web travel.

5. The drying section of claim 4, wherein the first drying group is preceding and the second drying group is following.

6. The drying section of claim 5, wherein after the last one of the first drying cylinders in the first drying group in the path of web travel, the associated reversing roller is the last one of the first reversing rollers, the support belt with the web jointly travel over the last one of the first reversing rollers;

a first one of the second reversing rollers which precedes the first one of the second drying cylinders in the path of web travel;

the first one of the second reversing rollers comprises a suction roller, the first one of the second reversing rollers is the means for feeding the web above the second support belt and is so placed with respect to the last one of the first reversing rollers that the first one of the second reversing rollers receives the web from the first support belt downstream in the path of web travel from the path of the first support belt over the last one of the first reversing rollers.

7. The drying section of claim 6, further comprising means for generating a vacuum condition disposed on the side of the first support belt that is away from the side of the first support belt on which the web is supported, and the vacuum generating means being disposed along the path from the last one of the first reversing rollers to the first one of the second reversing rollers, the vacuum generating means being adapted for drawing at least the edge regions of the web against the first support belt.

8. The drying section of claim 7, wherein the vacuum generating means has a stabilizer wall which extends along the direction of travel of the first support belt, and the stabilizer wall has an edge toward the first support belt which diverges away from the first support belt in the direction of travel of the first support belt.

9. The drying section of claim 4, wherein the second drying group is preceding and the first drying group is following.

10. The drying section of claim 9, wherein after the last one of the second drying cylinders in the second drying group in the path of web travel, the associated reversing roller is the last one of the second reversing rollers, the support belt with the web jointly travel over the last one of the second reversing rollers;

a first one of the first reversing rollers precedes the first one of the first drying cylinders;

the first one of the first reversing rollers comprises a suction roller, the first one of the first reversing rollers is the means for feeding the web below the first support belt and is so placed with respect to the last one of the second reversing rollers that the first one of the first reversing rollers receives the web from the second support belt downstream in the path of web travel from the path of the second support belt over the last one of the second reversing rollers.

11. The drying section of claim 10, further comprising means for generating a vacuum condition disposed on the side of the second support belt that is away from the side of the second support belt on which the web is supported, and the vacuum generating means being disposed along the path from the last one of the second reversing rollers to the second one of the first reversing rollers, the vacuum generating means being adapted for drawing at least the edge regions of the web against the second support belt.

12. The drying section of claim 11, wherein the vacuum generating means has a stabilizer wall which extends along the direction of travel of the second support belt, and the stabilizer wall has an edge toward the second support belt which diverges away from the second support belt in the direction of travel of the second support belt.

13. The drying section of claim 1, wherein the first drying group has an associated first plurality of guide rollers over which the first support belt passes for returning the first support belt to the first of the drying cylinders in the first row thereof; and the second drying group has an associated second plurality of guide rollers below which the second support belt passes for returning the second support belt to the second of the drying cylinders in the second row thereof.

14. The drying section of claim 13, wherein the beam means comprises a pair of longitudinally extending, spaced apart beams passing horizontally under the drying groups.

15. The drying section of claim 14, wherein at least nearly all of the guide rollers are supported on the longitudinal beams.

16. The drying section of claim 15, in which each guide roller has a rotation axis and has a respective pair of journal pins at its opposite ends and on the axis at which the guide roller rotates; the journal pins of at least one guide roller are shorter in length along the axis of the roller than the respective journal pins of the other guide rollers, and the guide roller with the shorter journal pins is disposed at the inner side surfaces of the longitudinal beams; and support means in the drying section for the journal pins.

17. The drying section of claim 14, further comprising a hood over the drying groups for containing vapors.

18. The drying section of claim 17, further comprising an intermediate floor below the drying cylinders and below the reversing rollers of all of the drying groups, and the floor being connected with the longitudinal beams.

19. The drying section of claim 18, wherein at least the predominant part of the intermediate floor is of airtight construction, such that the drying section is enclosed inside the hood, the beams and the intermediate floor for containing vapors therein.

20. The drying section of claim 14, further comprising an intermediate floor below the drying cylinders and the reversing rollers, and the floor being connected with the longitudinal beams.

21. The drying section of claim 20, wherein the intermediate floor is beneath the second guide rollers at a spacing such that there is at least 1 to 2 m present between the second guide rollers and the intermediate floor below.

22. The drying section of claim 19, wherein the intermediate floor is placed beneath the second guide rollers at a spacing such that there is at least 1 to 2 m present between second guide rollers and the intermediate floor below.

23. The drying section of claim 1, wherein the second cylinder axes are at the same height above the longitudinal beams as the first cylinder axes.

24. A drying section for a machine for fabricating a fiber web, the drying section comprising:

a first plurality of heatable drying cylinders arranged in a first row and forming a first drying group; the first drying cylinders having respective first cylinder axes of rotation; the first cylinders having top sides;

a second plurality of heatable drying cylinders arranged in a second row and forming a second drying group which is adjacent the first drying group; the second drying cylinders having respective second cylinder axes of rotation; the second drying cylinders having bottom sides;

a first upper endless web support belt, means for guiding the first belt over the top sides of each of the first drying cylinders for holding the web between the first belt and the top sides of the first drying cylinders;

a second lower endless web support belt, means for guiding the second belt under the bottom sides of each of the second drying cylinders for holding the web between the second belt and the bottom sides of the second drying cylinders;

means for transmitting the web from the respective web support belt at the end of the drying group that is preceding along the path of web travel to the respective web support belt at the start of the next drying group that follows along the path of web travel;

longitudinal beam means extending in the lengthwise direction of the machine past the first and second drying groups, the drying cylinders being supported on the beam means;

the second drying cylinder axes being at least at the same height above the longitudinal beams as the first drying cylinder axes.

25. The drying section of claim 24, wherein the second cylinder axes are at a greater height above the longitudinal beam means than the first cylinder axes.

26. The drying section of claim 24, wherein the second cylinder axes are at the same height above the longitudinal beam means as the first cylinder axes.

27. The drying section of claim 24, wherein the first row of drying cylinders is a horizontal row, the second row of drying cylinders is a horizontal row, and the longitudinal beam means extend horizontally in the lengthwise direction of the machine past the first and second horizontal rows of drying cylinders.

* * * * *